US011472051B2

(12) United States Patent
Siegmann et al.

(10) Patent No.: US 11,472,051 B2
(45) Date of Patent: Oct. 18, 2022

(54) SHAVING RAZOR SYSTEM

(71) Applicant: The Gillette Company LLC, Boston, MA (US)

(72) Inventors: Eric Glenn Siegmann, Quincy, MA (US); Nicholas Robert Harrington, Natick, MA (US); Vincent Paul Walker, Jr., Bridgewater, MA (US); Jack Anthony Washington, Mendon, MA (US)

(73) Assignee: The Gillette Company LLC, Boston, MA (US)

( * ) Notice: Subject to any disclaimer, the term of this patent is extended or adjusted under 35 U.S.C. 154(b) by 51 days.

(21) Appl. No.: 17/197,159

(22) Filed: Mar. 10, 2021

(65) Prior Publication Data

US 2021/0283791 A1 Sep. 16, 2021

Related U.S. Application Data

(60) Provisional application No. 62/987,652, filed on Mar. 10, 2020.

(51) Int. Cl.

| | |
|---|---|
| ***B26B 21/44*** | (2006.01) |
| ***B26B 21/52*** | (2006.01) |
| ***B26B 21/22*** | (2006.01) |

(52) U.S. Cl.

CPC ..... *B26B 21/446* (2013.01); *B26B 21/225* (2013.01); *B26B 21/521* (2013.01); *B26B 21/522* (2013.01)

(58) Field of Classification Search

None

See application file for complete search history.

(56) References Cited

U.S. PATENT DOCUMENTS

| | | | | |
|---|---|---|---|---|
| 1,673,590 | A | 6/1928 | Redheffer | |
| 4,635,361 | A * | 1/1987 | DeMars | B26B 21/446 30/535 |
| 4,858,314 | A | 8/1989 | Cunningham | |
| D325,652 | S | 4/1992 | Byrne | |
| 5,269,062 | A | 12/1993 | Dallaire et al. | |
| D343,026 | S | 1/1994 | Dallaire et al. | |

(Continued)

FOREIGN PATENT DOCUMENTS

| | | |
|---|---|---|
| FR | 2426549 A1 | 12/1979 |
| RU | 128963 U1 | 6/2013 |

(Continued)

OTHER PUBLICATIONS

PCT Search Report and Written Opinion for PCT/US2021/021602 dated Jul. 19, 2021, 15 pages.

(Continued)

*Primary Examiner* — Hwei-Siu C Payer

(74) *Attorney, Agent, or Firm* — John M. Lipchitz

(57) ABSTRACT

A handle for a personal care system with a first end having a head configured to engage a shaving cartridge, a second end with a partially enclosed ring having a first arm with a first end facing a first end of a second arm to defines a gap having a width. The first and second arms define an undercut region below the gap. A lower surface extends between the partially enclosed ring and the head, wherein the lower surface and the partially enclosed ring are configured to receive a container.

19 Claims, 10 Drawing Sheets

(56) References Cited

U.S. PATENT DOCUMENTS

| | | | | |
|---|---|---|---|---|
| D372,557 | S | 8/1996 | Mitchell | |
| 5,701,674 | A | 12/1997 | Mitchell | |
| 5,913,317 | A * | 6/1999 | Tiram | A45D 42/08 132/316 |
| 7,726,032 | B1 * | 6/2010 | Hernandez | B26B 21/523 30/526 |
| 8,510,957 | B2 | 8/2013 | Wain et al. | |
| 8,607,458 | B2 | 12/2013 | Hosseini et al. | |
| D887,642 | S | 6/2020 | Hodgson | |
| 10,800,058 | B2 | 10/2020 | Eagleton et al. | |
| 11,141,873 | B2 | 10/2021 | Hodgson | |
| D957,056 | S * | 7/2022 | Siegmann | D28/48 |
| 2012/0102745 | A1 | 5/2012 | Jessemey et al. | |
| 2013/0145623 | A1 | 6/2013 | Wain | |
| 2015/0121705 | A1 | 5/2015 | Coffindaffer et al. | |
| 2020/0254639 | A1 * | 8/2020 | Bridges | B65D 83/0055 |
| 2021/0283791 | A1 | 9/2021 | Siegmann et al. | |

FOREIGN PATENT DOCUMENTS

| | | | |
|---|---|---|---|
| RU | 129224 | U1 | 6/2013 |
| WO | 2007141816 | A1 | 12/2007 |
| WO | 2018084822 | A1 | 5/2018 |

OTHER PUBLICATIONS

All Office Actions; U.S. Appl. No. 29/760,928, dated Oct. 22, 2021 and Feb. 24, 2022.
All Office Actions; U.S. Appl. No. 29/843,062, filed Jun. 17, 2022, No Office Actions as of Aug. 22, 2022.

* cited by examiner

SHAVING RAZOR SYSTEM

FIELD OF THE INVENTION

The present invention relates to personal care articles and more particularly to shaving razor systems that have a shaving razor cartridge mounted to an ergonomically formed handle that is configured to removably retain a container of fluid.

BACKGROUND OF THE INVENTION

In general, a cartridge or blade unit of a safety razor has at least one blade with a cutting edge which is moved across the surface of the skin being shaved by means of a handle to which the cartridge or blade unit is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled.

Razor blade assemblies have been disclosed wherein cutting edge portions of the blade members are held between skin engaging surfaces which are generally referred to as the guard and cap of the razor blade assembly. The guard contacts the skin in front of the blade member(s) and the cap contacts the skin behind the blade member(s) during a shaving stroke. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

It is generally known that applying a shaving lotion (e.g., shaving oil or cream) prior to shaving aids in hydrating the hair and lubricating the surface of the skin, which aids in reducing nicks, cuts and irritation. It is also generally known that applying a shaving lotion (e.g., aftershave balm or moisturizer) helps moisturize the skin and sooth shaving irritation. Various razors have been developed that combine a razor with a shaving product dispensing container, wherein the container forms a part of the handle. Many other personal care articles also incorporate a mechanical device that works in collaboration with a chemical composition other than wet shaving razors. Examples may include, but are not limited to shaving brushes, exfoliation and cleansing devices, electric razors and toothbrushes.

Numerous designs of containers are available for dispensing various types of fluid compositions for personal care products. For example, tottles are readily available in numerous sizes and configurations. The term "tottle" is derived from the combination of tube and bottle. The tottle stands on the dispensing cap portion of the bottle, which allows the product to be easily dispensed. This can be particularly advantageous for dispensing compositions that are highly viscous, as gravity will naturally cause the product to settle near the dispensing orifice when the dispenser is stored so that the dispensing portion is at the bottom. The thickness of the tottle walls also allows the product to be impact resistant but flexible enough to be squeezed to easily dispense the contents. Tottles are most commonly made out of polyethylene terephthalate (PET), low density polyethylene (LDPE) or high density polyethylene (HDPE) plastic and commonly have a dispensing cap such as a screw-off cap or a flip-top cap. Dispensing caps may seal directly to the tottle, or may be attached to the tottle and seal to itself.

However, there are no simple and intuitive structures or methods for removably attaching a liquid container to a shaving razor handle and ergonomically configuring the liquid container and handle system. Thus, there is a need for an easy method and apparatus for removably attaching a liquid container (e.g., a bottle, tube or tottle) to a personal care article in a simple, efficient and secure manner by either the original manufacturer or the consumer. Thus, there is a need for a shaving razor cartridge mounted to an ergonomic handle that removably retains a liquid container, such as a tottle, tube or a bottle.

SUMMARY OF THE INVENTION

In one aspect, the invention features, in general a handle with a first end having a head configured to engage a shaving cartridge. A second end with a partially enclosed ring having a first arm with a first end facing a first end of a second arm and defines a gap having a width. The first and second arms define an undercut region below the gap. A lower surface extends between the partially enclosed ring and the head. The lower surface and the partially enclosed ring are configured to receive a tube of a container.

In another aspect, the invention features, in general a personal care system with a handle having a head at a first end with a tab that defines a slot. The handle has a partially enclosed ring at a second end. The partially enclosed ring has a first arm with a first end facing a first end of a second arm to define a gap having a width. The first and second arms define an undercut region below the gap. A lower surface extends between the head and the partially enclosed ring. A shaving razor cartridge is mounted to the shaving razor handle. The shaving razor cartridge defining a shave surface. A container mounted to the handle. The container has a flange at a first end, a cap at a second end and a tube extending between the flange and the cap. The tube is removably positioned within the partially enclosed ring and the flange is removably positioned within the slot of the tab.

In another aspect, the invention features, in general a method of assembling a shaving razor system by mounting a shaving razor cartridge to a first end of a handle. At least one notch is die cut into a flange of a container. The flange is positioned within a slot of the handle. The notch of the flange is engaged with an alignment member on the handle. A tube of the container is inserted through a gap defined by a partially enclosed ring on the handle. The tube is positioned on a lower surface of the shaving razor handle. The tube is inserted through the gap defined by the partially enclosed ring on the handle after engaging the notch.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
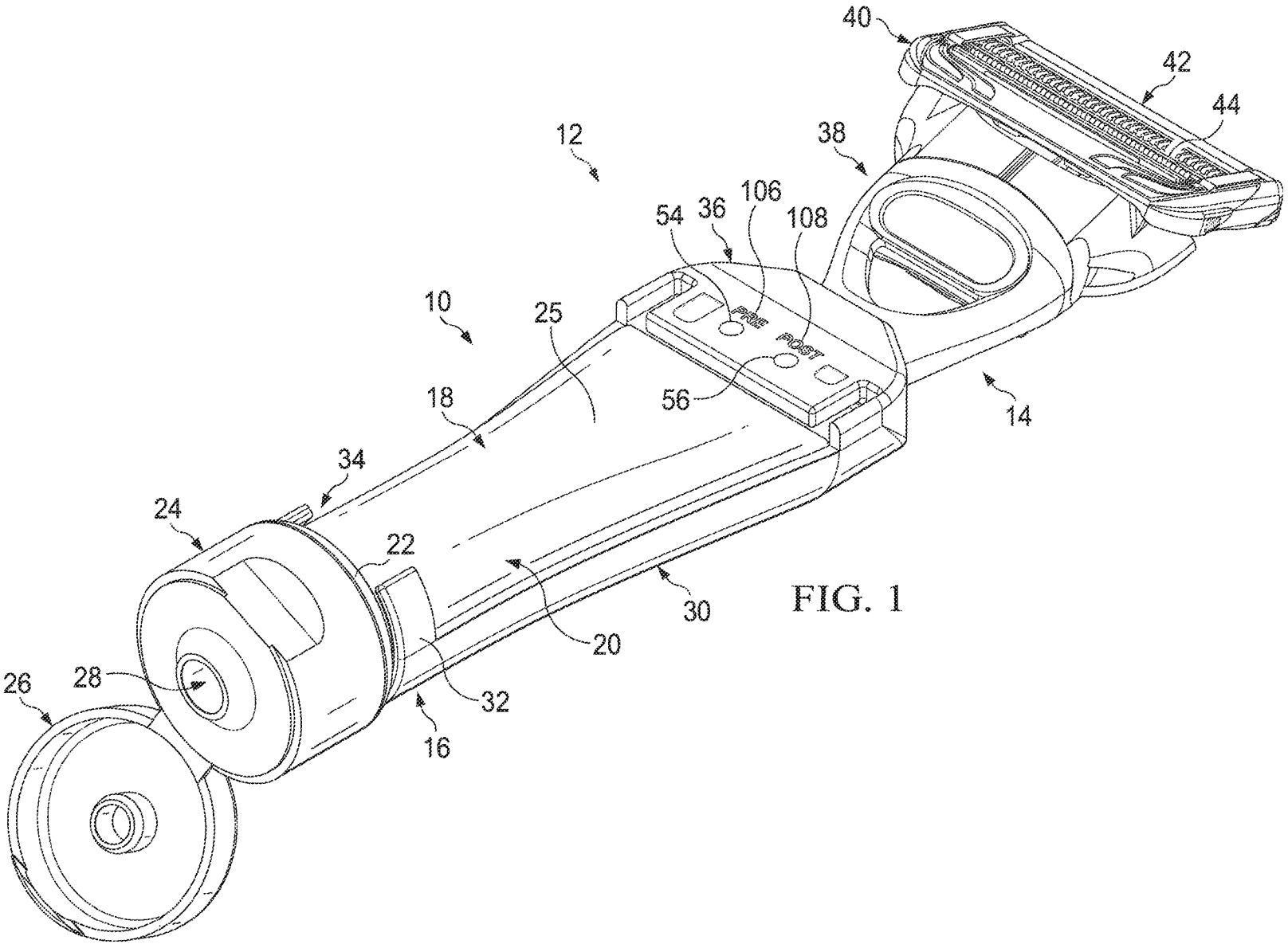
FIG. 1 is a top perspective view of a personal care system according to one possible embodiment of the present invention.

Referring to FIG. 1, a perspective view is shown of a personal care system 10. It is understood that although the personal care system 10 illustrated is a shaving razor system, the personal care system may also include shaving brushes, exfoliation and cleansing devices, electric razors and toothbrushes. The personal care system 10 may include a handle 12 having a first end 14 and a second end 16. In certain embodiments, the handle 12 may configured to receive a container 18 (e.g., a tottle, tube or bottle) that contains a personal care liquid, such as a pre or post shaving aid composition. The container 18 may include a body 20 that is flexible, which allows the user to squeeze out the contents contained within the body 20. For example, a top surface 25 of the body 20 may be exposed to facilitate easy access to a majority of the top surface 25 to squeeze the body 20. The container 18 may have a shoulder 22 positioned between a cap 24 and the body 20. The cap 24 may include a removable cover 26, such as a flip top, disc top or screw top that blocks an opening 28 in the cap 24 to allow easy dispensing.

As will be explained in greater detail below, a bottom surface 30 of the handle 12 may support the container 18 and prevent the container 18 from being squeezed, thus providing sufficient rigidity for holding the handle 12 during use. The second end 16 of the handle 12 may include a partially enclosed ring 32. Accordingly, the container 18 and/or the partially enclosed ring must deform in order for the container 18 to be inserted or removed from the handle 12. In certain embodiments, the partially enclosed ring 32 may have an inner diameter that is slightly smaller than an outer diameter of the body 20. Accordingly, the body 20 may temporarily deform as it is inserted (and removed) between a gap 34 defined by the partially enclosed ring 32. The partially enclosed ring 32 may extend around a portion of the container 18 forming an undercut region 35 below the gap 34 (e.g., undercut is a special type of recessed surface that is inaccessible using a straight tool) for easy attachment and removal of the container 18 to the handle 12. In certain embodiments, the partially enclosed ring 32 may expand to receive a portion of the container 18 (e.g., body 20 or shoulder 22). It is also understood there may be a combination of both the container 18 (e.g., the body 20) deforming and the partially enclosed ring 32 flexing during insertion of the container 18. An outer diameter of the shoulder 22 may be greater than the inner diameter of the partially enclosed ring. In certain embodiments, the shoulder 22 may be positioned against the partially enclosed ring 32 to facilitate securing the container 18 in place. However, the partially enclosed ring 32 may alternatively be secured around the shoulder 22 instead of the body 20. It is understood that the body 20 may include structures that are not circular (e.g., oval shapes), thus the diameter may be the distance between the two opposing sides of the body 20 that must pass through the gap 34 to be captured within the partially enclosed ring 32.

The first end 14 of the handle 12 may include a head 36. As will be explained in greater detail below, the head 36 may be configured to removably retain a portion of the container 18. The body 20 may be retained between the head 36 and the partially enclosed ring 32. The head 36 may include a coupler 38 configured to engage functional attachment such as a shaving razor cartridge 40 defining a shave surface 42 having one or more blades 44 for cutting hair. However, it is understood that other functional attachment such for various types of personal care devices may be mounted to the coupler 38 in lieu of the shaving razor cartridge 40, such as a toothbrush or a skin care applicator. The shaving razor cartridge 40 may be mounted detachably on the handle 12 (i.e., via the coupler 38) to enable the shaving razor cartridge 40 to be replaced by a fresh shaving razor cartridge 40 when the sharpness of the blades 44 has diminished to an unsatisfactory level, or it may be attached permanently to the handle 12 with the intention that the entire handle 12 and the shaving razor cartridge 40 be discarded when the blade or blades 44 have become dulled.

The gap 34 of the partially enclosed ring 32 may face in the same direction as the shave surface 42. An open area of the handle 12 between the partially enclosed ring 32 and the head 36 may allow access to the user for applying pressure to the body 20 (top surface 25) to squeeze out the contents of the container 18. Accordingly, the working part of the body 20 (i.e., area of the top surface 25 that a user presses to squeeze out liquid) and the working part of the shaving razor cartridge 40 (i.e., shave surface 34) may face the same direction for more intuitive use. The top surface 25 of the body 20 may face in the same direction as the shaving surface, which may facilitate proper holding of the handle 12 so the tube is not squeezed during shaving. For example, the consumer may grip the handle 12 without applying force on the top surface 25 when shaving.

Figure 2:
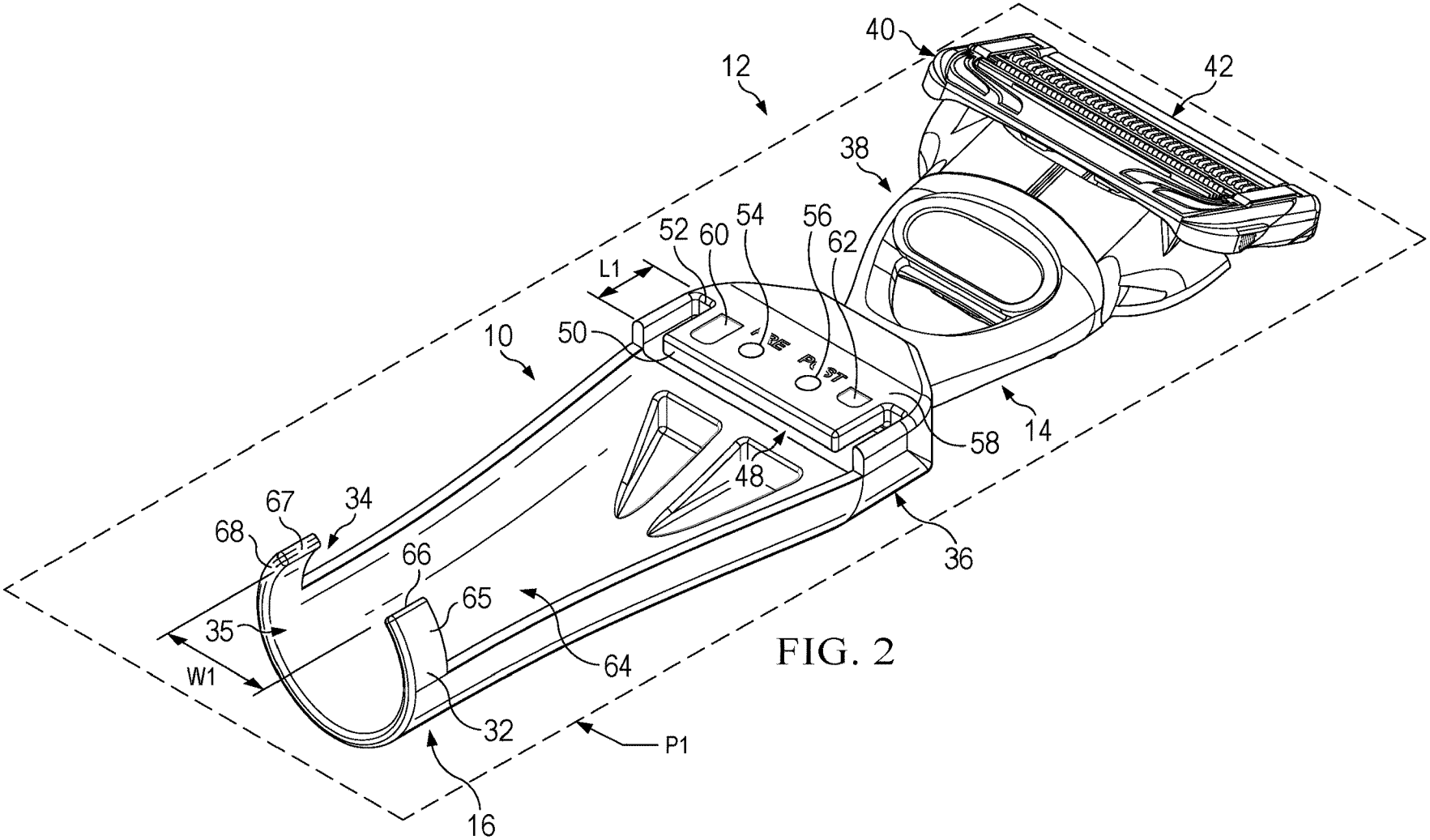
FIG. 2 is top perspective view of a handle of the personal care system of FIG. 1.

Referring to FIG. 2, a top perspective view of the handle 12 of the personal care system 10 of FIG. 1 is illustrated. The container 18 has been removed from FIG. 2 for clarity. The head 36 may have a tab 46 that defines a slot 48 dimensioned to receive a portion of the container 18 of FIG. 1. The slot 48 may have a first length "L1" from a front face 50 of the tab 46 to a back wall 52 of about 4 mm to about 9 mm to receive a portion of the container 18 (FIG. 1). As will be explained in greater detail below, the tab 46 may have one or more windows 54 and 56 (e.g., openings, notches) to facilitate proper identification of the container 18 (FIG. 1). The windows 54 and 56 may be positioned on a top surface 58 of the tab 46 for easy identification during use to confirm proper loading and identification of the container 18. For example, the windows 54 and 56 may allow the user to see a portion of the container 18 through the tab 46. The top surface 58 of the tab 46 may also define one or more alignment indicators 60 and 62 (e.g., a recess).

The alignment indicators 60 and 62 on the tab 46 may include one or more recesses, protuberances or graphics. The alignment indicators 60 and 62 (e.g., recesses), may be on the top surface 58 of the tab 46 (FIG. 2) and correspond to container alignment members 72 and 74 hidden within the slot 48, thus providing a visual and/or tactile indication of the location of the corresponding alignment members 72 and 74 within the slot.

The shaving razor handle 12 may have a lower surface 64 extending between the partially enclosed ring 32 and the tab 46 that is dimensioned to receive the container 18 (e.g., the body 20 of FIG. 1). In certain embodiments, the lower surface 64 may be contoured (e.g., concave) to better contain the body 20 of the container 18 (FIG. 1). The partially enclosed ring 32 may include a first arm 65 with a first end 66 facing a first end 67 of a second arm 68 to define the gap 34. The gap 34 may have a width "W1" of about 4 mm to about 17 mm. The width of the undercut region 35 below the gap 34 may be greater than W1 to facilitate retaining the container 18. In certain embodiments, the partially enclosed ring 32 may be generally rigid, such that the body 20 of the container (FIG. 1) deflects to be received within the partially enclosed ring 32. However, it is understood that the arms 65 and 68 (e.g., the first ends 66 and 67) may partially deflect away from each other to receive the body 20 of the container 18 (FIG. 1). As further illustrated in FIG. 3A, in certain embodiments, the tab 46 may be positioned on a plane P1 below the partially enclosed ring 32 (e.g., first ends 66 and 67) to better retain the tapered geometry of the container 18.

Figure 3A:
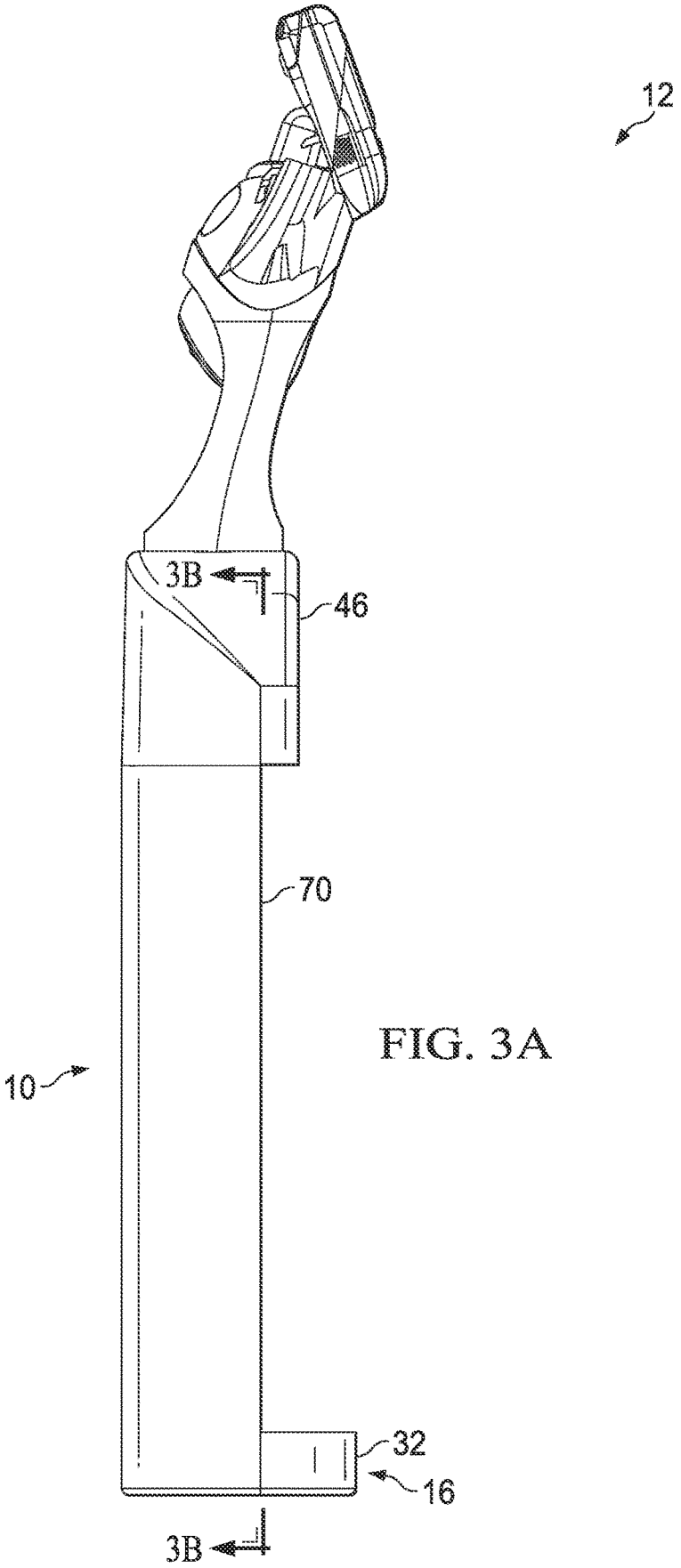
FIG. 3A is a side view of the personal care handle of FIG. 2.
Figure 3B:
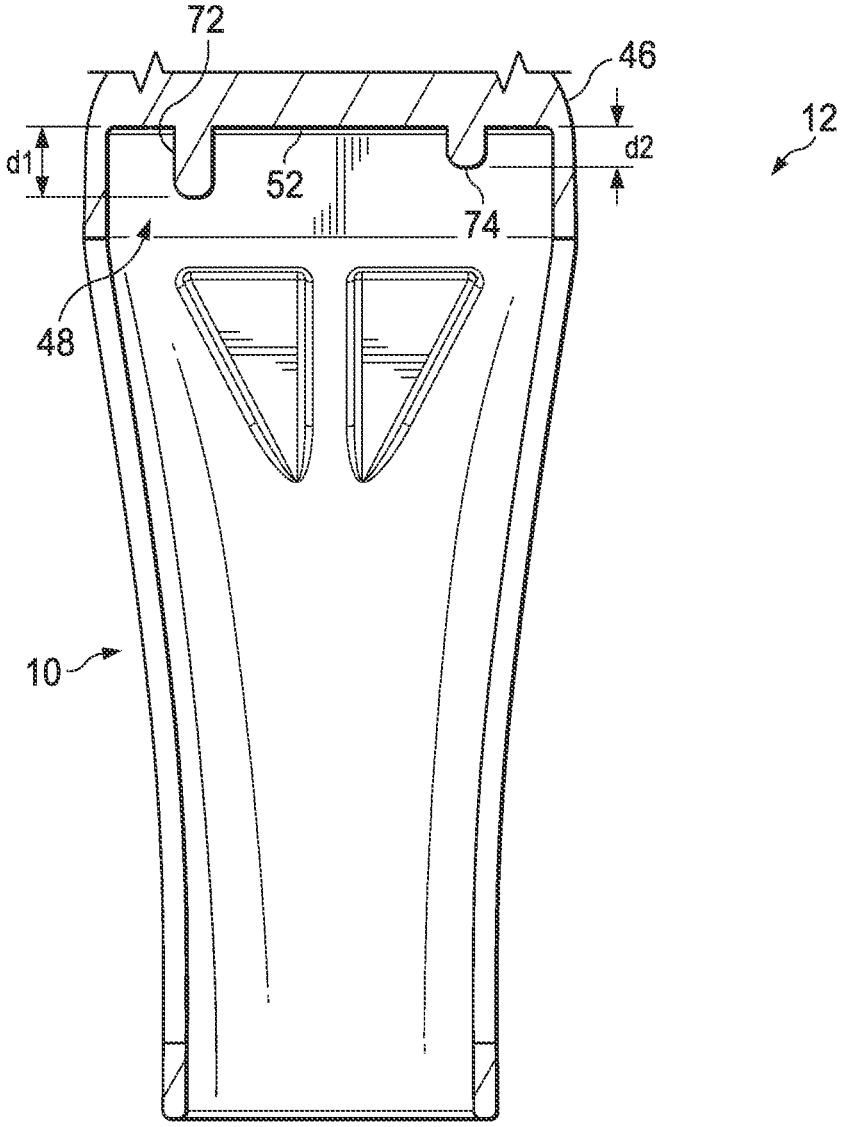
FIG. 3B is a cross sectional view of the handle, taken generally along the line 3B-3B of FIG. 3A.

Referring to FIG. 3A, a side view of the personal care system 10 is shown. FIG. 3B is a cross sectional view of a portion of the handle 12 of the personal care system 10, taken generally along the line 3B-3B of FIG. 3A. The tab 46 and the partially enclosed ring 32 may extend above a rim 70 of the handle 12. The rim 70 may contain about 30% to about 60% of the body 20 of the container 18 of FIG. 1. The rim 70 may extend between the tab 46 and the partially enclosed ring 32. As shown in FIG. 3B, the tab 46 may include one or more container alignment members 72 and 74, which may correspond to the alignment indicators 60 and 62 shown in FIG. 2. For example, the container alignment member 72 may be positioned directly below the alignment indicator 60 and the container alignment member 74 maybe be positioned directly below the alignment indicator 62. The container alignment members 72 and 74 may engage the handle alignment members 80 and 82, respectively. The container alignment members 72 and 74 may be positioned within the slot 48 (FIG. 2). The container alignment members 72 and 74 may extend from the back wall 52 within the slot 48 of the tab 46. In certain embodiments, the size of the container alignment members 72 and 74 may be different to facilitate proper loading orientation of the container 18 (FIG. 1). For example, the container alignment member 72 may have a dimension d1 that is different than a dimension d2 of the container alignment member 74. The dimension d1 may be about 1.5 to about 2 times the value of d2. For example, d1 may be about 4 mm to about 5 mm and d2 may be about 2 mm to about 3 mm. It is understood that the dimensions d1 and d2 may be either a length dimension (as shown in FIG. 3B) and/or a width dimension to allow the container 18 (FIG. 1) to be properly loaded within the handle 12 in a single orientation. The size and geometry of the container alignment members 72 and 74 may correspond with size and geometry of the handle alignment members 80 and 82. The size and geometry of the container alignment members may also corresponding with the alignment indicators 60 and 62. Accordingly, although a user may not see the container alignment members 72 and 74 because they are hidden by the top surface 58 of the tab, they are able to properly aligned the container 18 (FIG. 1) with the alignment indicators 60 and 62 (FIG. 2).

Figure 4:
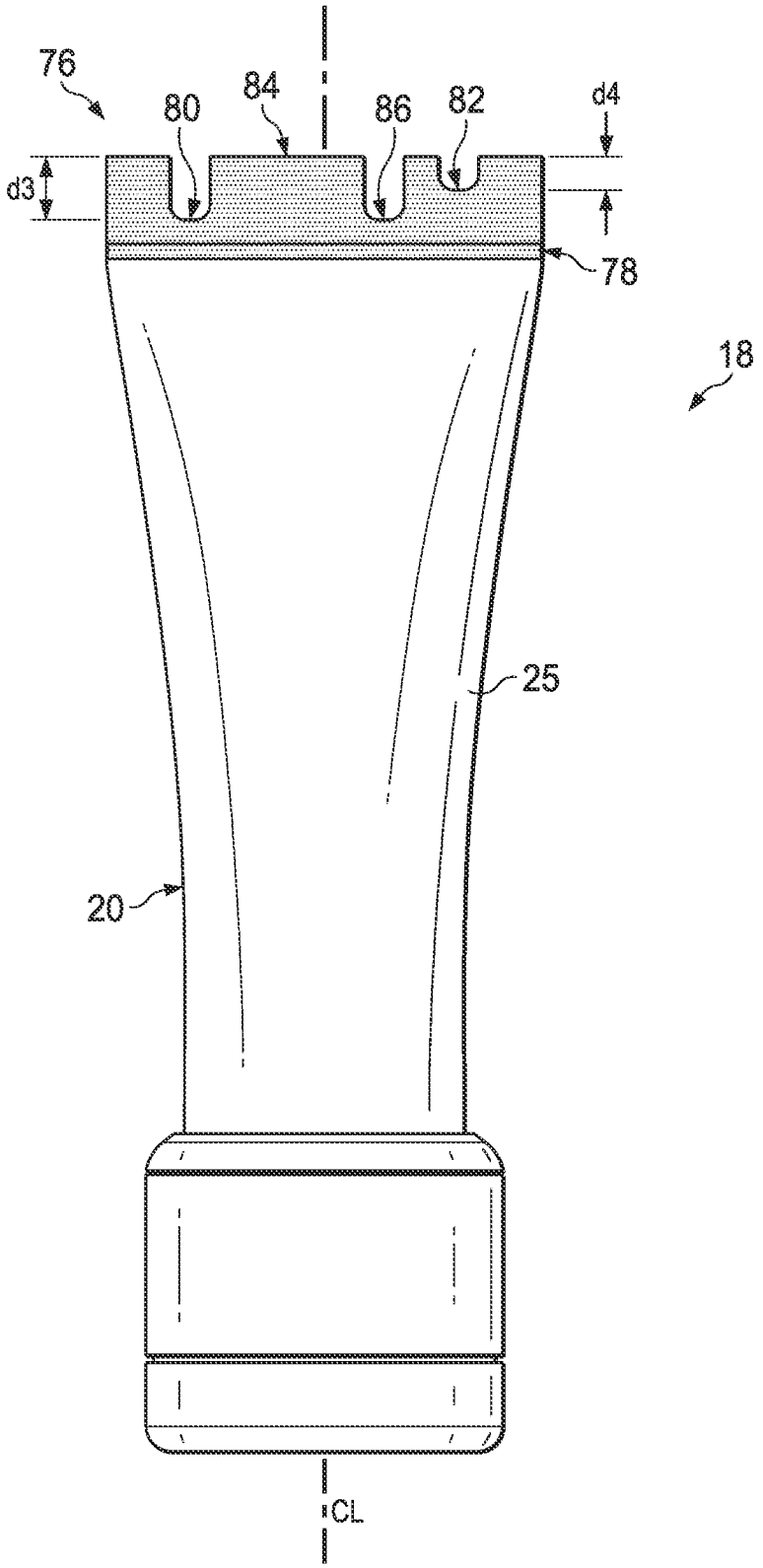
FIG. 4 is a front view of a container of that may be incorporated into the personal care system of FIG. 1.

Referring to FIG. 4, a front view of the container 18 is shown. The container 18 may have a first end 76 with a flange 78. The flange may be made from the same material as the body 20. In certain embodiments, the flange 78 may be created when the first end 76 of the container 18 is sealed as part of the manufacturing process. Accordingly, the flange 78 may be formed from any known forming or sealing means such as a crimp seal, heat seal, adhesive seal to provide a thinned area to facilitate insertion into the slot 48 of FIG. 2. The flange 78 may have one or more handle alignment members 80 and 82 that correspond to the container alignment members 72 and 74 of the tab 46 of FIG. 3B. For example, the flange 78 may define the handle alignment members 80 and 82 that are notches extending from a rear wall 84 of the flange 78.

In certain embodiments, the handle alignment member 80 may have a dimension "d3" extending into the flange 78 from the rear wall 84 that corresponds with the dimension d1 of FIG. 3B. Similarly, the handle alignment member 82 may have a dimension "d4" extending into the flange 78 from the rear wall 84 that corresponds with the dimension d2 of FIG. 3B. Thus, the dimension d3 may be similar to the dimension d1 and the dimension d4 may be similar to the dimension d2, but dimensions d3 and d4 may not be similar (e.g., d3 may be greater than d4). Accordingly the container alignment members 72 and 74 may allow for the flange 78 to slide within the slot 48 (FIG. 2) so the handle alignment member 80 engages the container alignment member 72 of the handle 12 (FIG. 3B), the handle alignment member 82 engages the container alignment member 74 of the handle 12 (FIG. 3B) and the rear wall 84 engages the back wall 52 of the tab 46 (FIG. 3B), thus ensuring the top surface 25 of the container 18 faces up (e.g., faces away from the lower surface 64, as shown in FIG. 1).

After the flange 78 is positioned properly within the slot 48 of the tab 46 (FIG. 2), then the body 20 may be inserted between the first ends 66 and 67 (FIG. 2) so the body 20 sits on the lower surface 64 of the handle 12 and the container 18 (e.g., the body 20) is captured within the partially enclosed ring 32 (FIG. 2). Although two handle alignment members 80 and 82 and two container alignment members 72 and 74 are shown, it is understood that a single container alignment member may be used with a single handle alignment member. It is understood, a single container alignment member 72 and 74 may be used with a single handle alignment member 80 and 82. Accordingly, the handle alignment member 80 and 82 may be offset from the centerline CL of the container 18 to ensure proper positioning within the handle 12 (i.e., may be inserted only one way). Although the handle alignment members 80 and 82 are shown as openings or notches, they may include protuberances configured to correspond to windows 54 and 56 in tab 42. Furthermore, the handle alignment members 80 and 82 may include visual indices configured to be visible through, windows 54 and 56 in tab 42. The handle alignment members 80 and 82 may further include visual indicators of the disposition that extend beyond the flange 78 along the body 20 so as to be visible on the container 18 when the container is loaded in the handle.

In certain embodiments, the flange 78 may have a different color than the tube 20 of the container 18. For example, the body 20 may be white or uncolored plastic and the flange 78 may be colored (e.g., painted blue or gray) in another operation. The flange 78 may define an opening 86 that extends completely through the flange 78. Accordingly, when the flange 78 is positioned within the slot 48 of the tab 46, the flange 78 may be visible through one of the windows 54, but not the other window 56 (FIG. 2). Thus, the opening 86 may be aligned within window 56 so the flange 78 is not visible through the window 56 of FIG. 2. In certain embodiments, the flange 78 may be die cut to form the handle alignment members 80, 82 and/or the opening 86.

Figure 5:
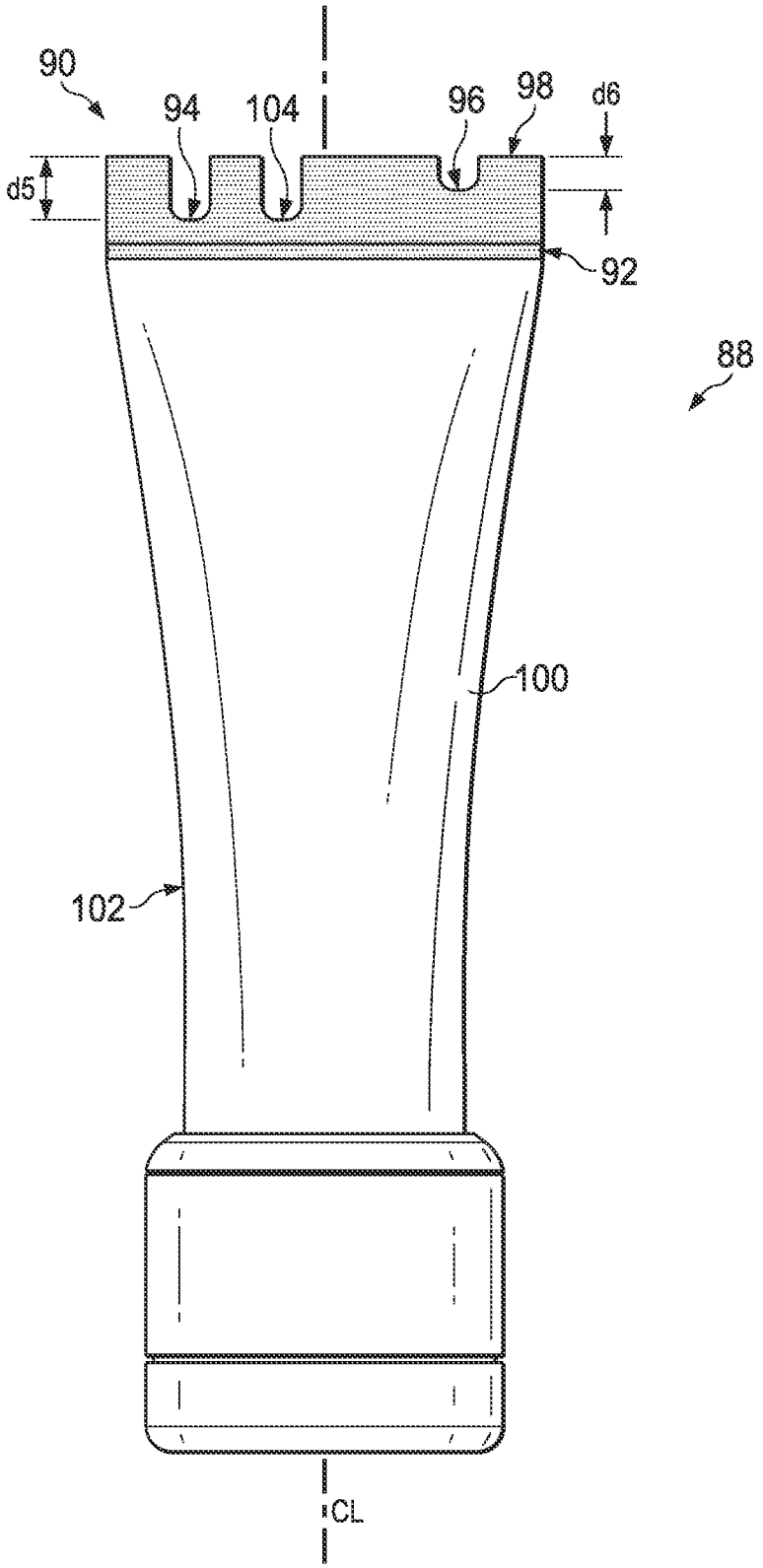
FIG. 5 is a front view of another embodiment of a container of that may be incorporated into the personal care system of FIG. 1.
Figure 6A:
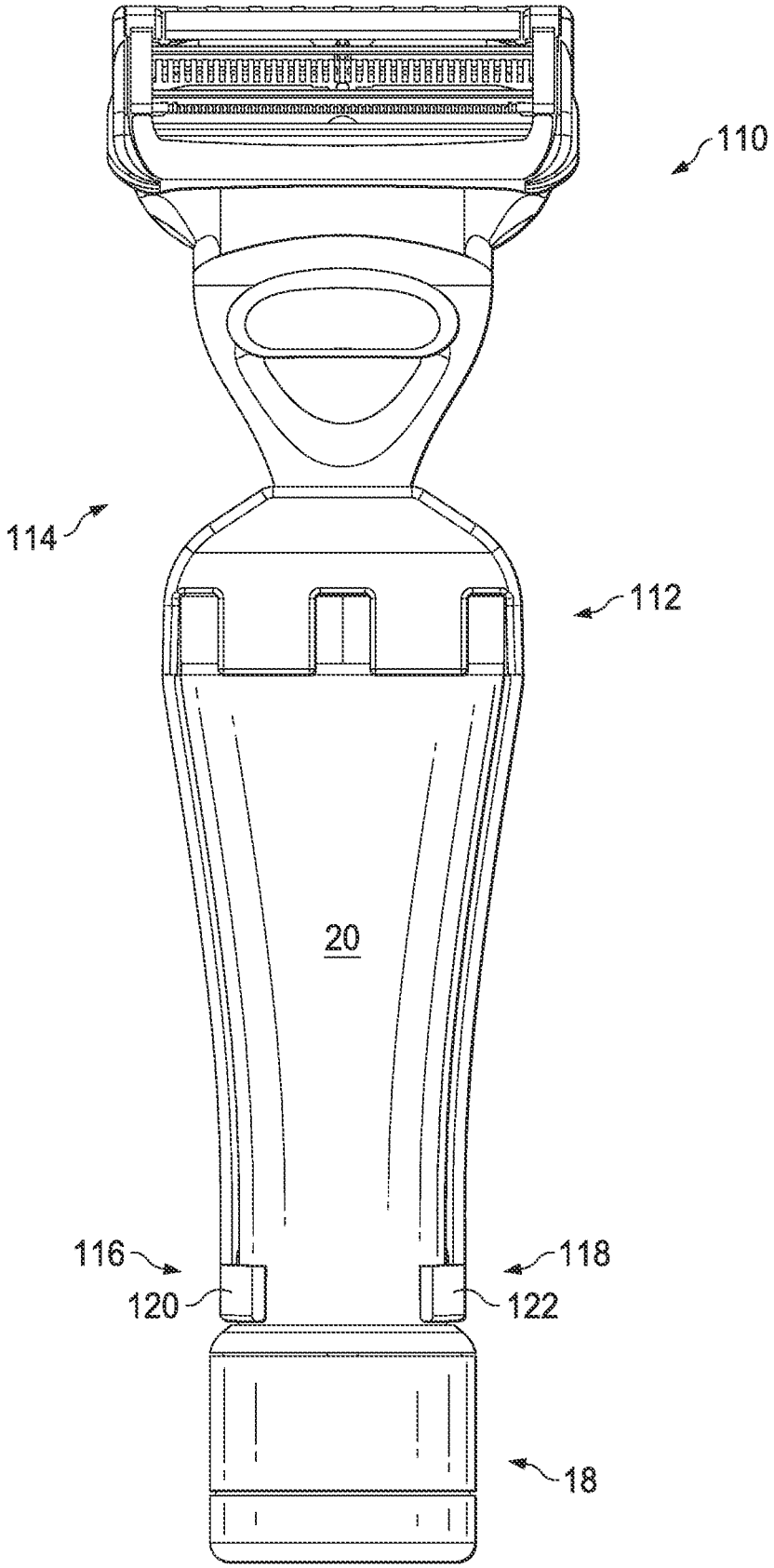
FIG. 6A is a front view of a personal care system according to another possible embodiment of the present invention.
Figure 6B:
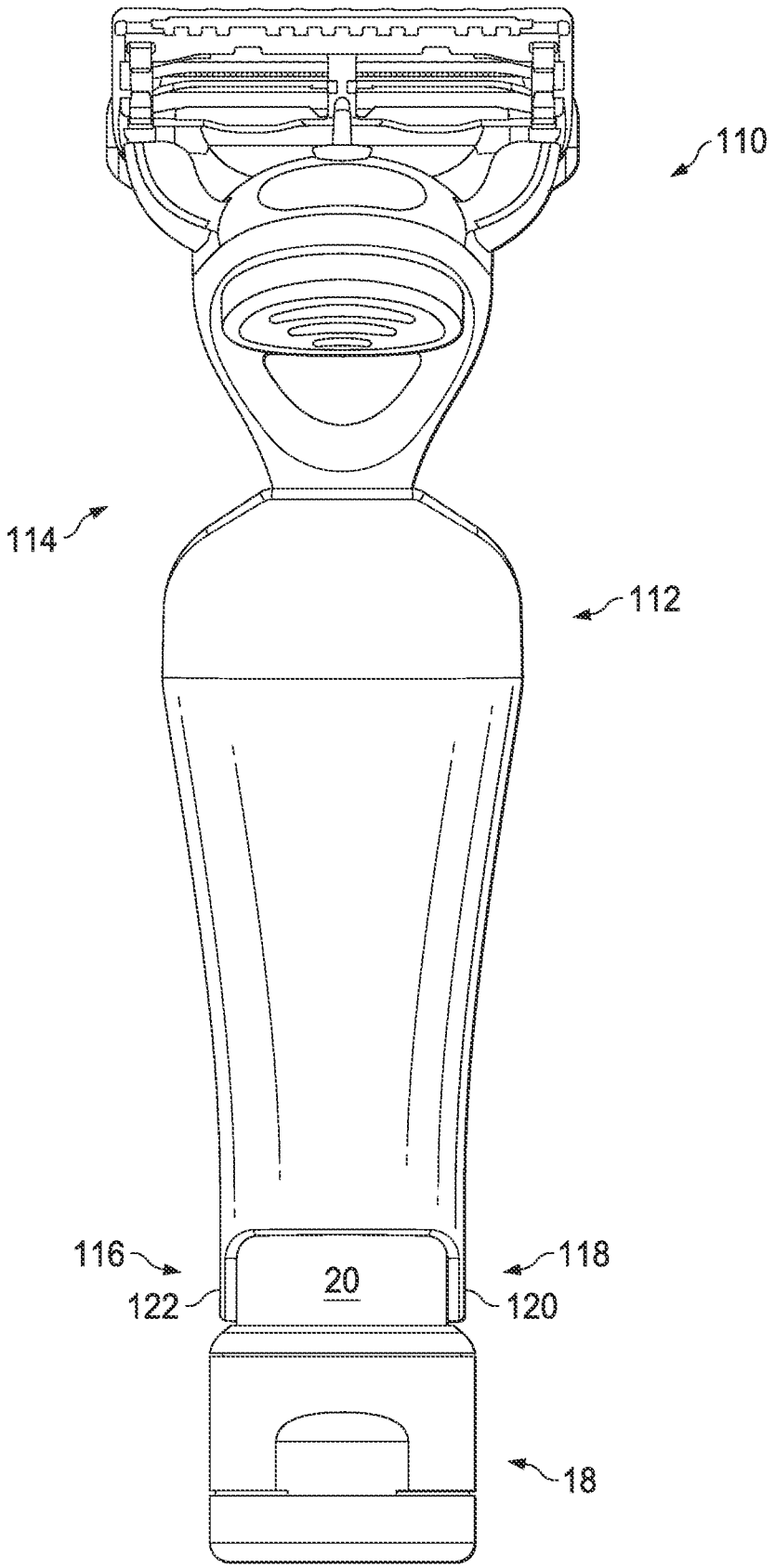
FIG. 6B is a rear view of the personal care system of FIG. 6A.
Figure 6C:
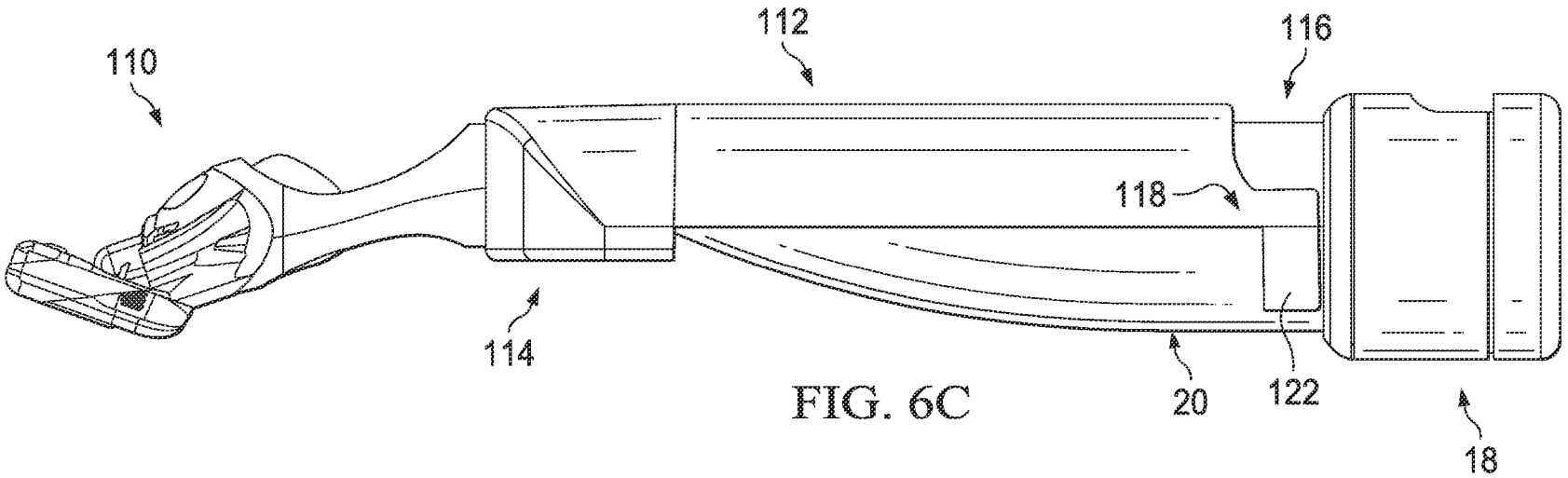
FIG. 6C is a first side view of the personal care system of FIG. 6A.
Figure 6D:
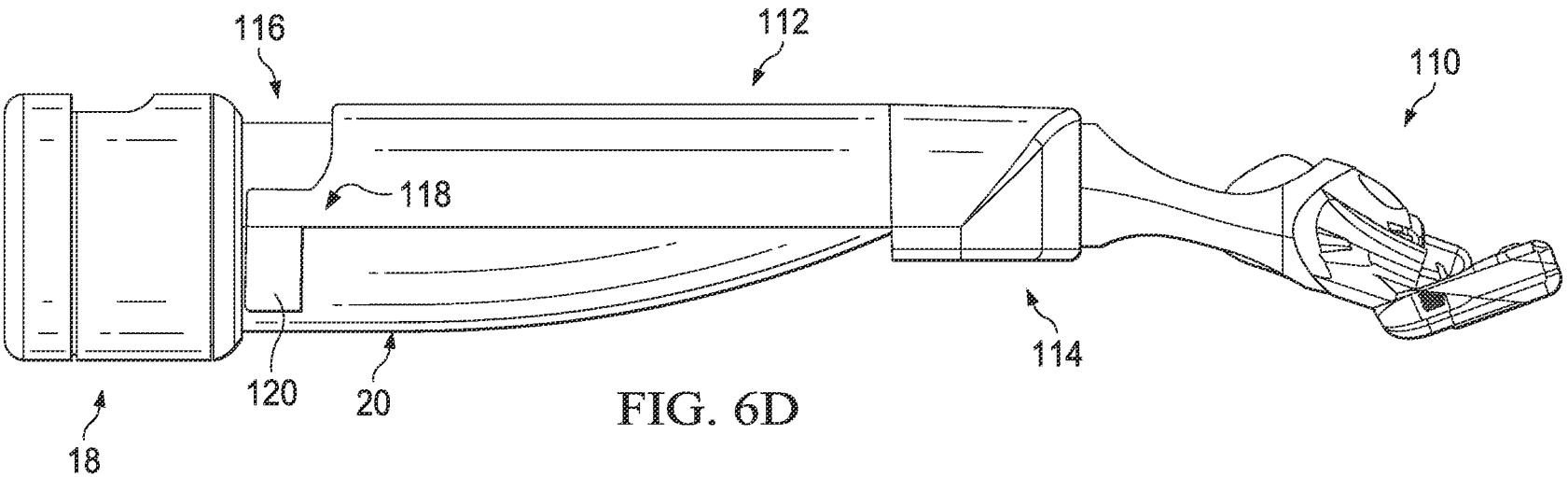
FIG. 6D is a second side view of the personal care system of FIG. 6A.

Referring to FIG. 5, a front view of another possible embodiment of a container 88 is shown. The container 88 may be similar to the container 18 previously described. However, the container 88 may be filled with a different chemical composition than the container 18 of FIG. 4. For example, the container 18 may contain a pre-shave lotion and the container 88 may contain a post-shave lotion, such as a moisturizer. The container 88 may have a first end 90 with a flange 92. The flange 92 may be formed from any known sealing means such as a crimp seal, heat seal, adhesive seal to provide a thinned area to insert into the slot 48 of FIG. 2. The flange 92 may have one or more handle alignment members 94 and 96 that correspond to the container alignment members 72 and 74 of the tab 46 of FIG. 3B. For example, the flange 92 may define the handle alignment members 94 and 96 that are notches extending from a rear wall 98 of the flange 92. In certain embodiments, the handle alignment member 94 may have a dimension "d5" extending into the flange 92 from the rear wall 98 that corresponds with the dimension d1 of FIG. 3B. Similarly, the handle alignment member 96 may have a dimension "d6" extending into the flange 92 from the rear wall 98 that corresponds with the dimension d2 of FIG. 3B. Thus, the dimension d5 may be similar to the dimension d1 and the dimension d6 may be similar to the dimension d2, but dimensions d5 and d6 may not be similar. Accordingly the handle alignment members 94 and 96 may allow for the flange 92 to slide within the slot 48 (FIG. 2) so handle alignment member 94 engages the container alignment member 72 of the handle 12 (FIG. 3B), the handle alignment member 96 engages the container alignment member 74 of the handle 12 (FIG. 3B) and the rear wall 98 engages the back wall 52 of the tab 46 (FIG. 3B), thus ensuring a top surface 100 of the container 88 faces up (e.g., away from the lower surface 64). After the flange 92 is positioned properly within the slot 48 of the tab 46 (FIG. 2), then a body 102 of the container 88 may be inserted between the first ends 66 and 67 (FIG. 2) so the body 102 at least partially abuts the lower surface 64 of the handle 12 and the container 88 (e.g., the body 102) is captured within the partially enclosed ring 32 (FIG. 2).

Similar to the flange 78 previously described, the flanged 92 may have a different color than the body 102 of the container 88. For example, the body 102 may be white or uncolored plastic and the flange 92 may be colored (e.g., painted blue or gray) in another operation. The flange 92 may define an opening 104 that extends completely through the flange 92. Accordingly, when the flange 92 is positioned within the slot 48 of the tab 46, the flange 92 may be visible through one of the windows 56, but not the other window 54 (FIG. 2). Thus, the opening 104 may be aligned within window 54 so the flange 92 is not visible through the window 56 of FIG. 2. Accordingly, the opening 104 of the container 88 may be aligned with a different window than the opening 86 of the container 18. Thus, one window 54 may have an indicia 106 signaling to the consumer one type of chemical composition of the container 18 and the other window 56 may have an indicia 108 signaling to the consumer a different type of chemical composition of the container 88. The handle alignment indicators such as the coloring, notches and/or protuberances on the flanges 78 and 92 may make it easier for consumer to identify the flanges 78 and 92 through the respective windows 54 and 56. In certain embodiments, the flange 92 may be die cut to form the handle alignment members 94, 96 and the opening 104.

The tab 46 may have one or more alignment indicators such as windows 54 and 56 (e.g., openings, notches, etc.) or recesses 60 and 62. The windows 54 and 56 facilitate proper loading and identification of the container 18 by allowing the user to see a portion of the container 18 (e.g. the flange 78) through the tab 46, and that portion of the container 18 may include visual indices intended to be visible through the windows 54 and 56 only when the proper container has been loaded in the proper orientation. Alternately, that portion of the container 18 inserted into the slot 48 may comprise protuberances that fit into the windows 54 and 56 only when the proper container has been loaded in the proper orientation.

It is understood that there are other potential embodiments that include the partially enclosed ring 32 described in FIGS. 1-5. For example, the partially enclosed ring 32 may be open on more than the one side that receives container 18 (e.g., the body 20). Referring to FIGS. 6A-6D and FIG. 7, another possible embodiment of a personal care system 110 is illustrated having a handle 112 with a first end 114 and a second end 116. In certain embodiments, the handle 112 may configured to receive the container 18 previously described above. The second end 116 of the handle 112 may include a partially enclosed ring 118.

Figure 7:
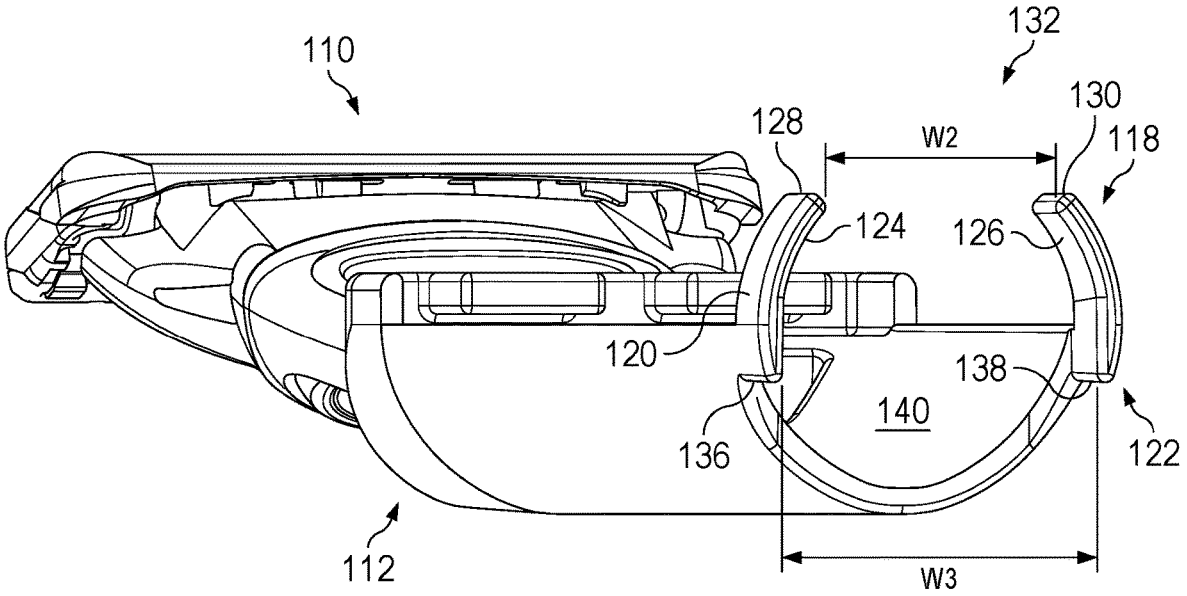
FIG. 7 is a perspective view of the of a handle of the personal care system of FIG. 6A.

Referring to FIG. 7, the partially enclosed ring 118 may comprise a pair of spaced apart arms 120 and 122, each having respective a concave inner surface 124 and 126 to engage the container 18 (e.g., body 20) shown in FIGS. 6A-6D. The inner surfaces 124 and 126 may face each other to better retain the container 18. The spaced apart arms 120 and 122 may extend around portion of the container 18. The arm 120 may include a first end 128 facing a first end 130 of the arm 122 to define a gap 132 dimensioned to receive the container 18. The gap 132 may be similar to the gap 34. The first end 128 may be spaced apart from the first end 130 to define a width "W2" of about 4 mm to about 17 mm, or more preferably about 7 mm to about 11 mm to receive the container 18 (FIGS. 6A-6D). The arm 120 may include a second end 136 facing a second end 138 of the arm 122 to define a gap 140. The second ends 130 and 132 may be spaced apart to define a width "W3" that is greater than the width "W2". The width "W3" may provide additional flexibility to the arms 120 and 122 to allow for easier insertion and removal of the container 18 (FIGS. 6A-6D). The width "W3" may also allow for a user to insert a finger between the arms 120 and 122 to push the container 18 out of the handle 112.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A handle for a personal care system comprising:

a first end having a head configured to engage a shaving cartridge;

a second end with a partially enclosed ring having a first arm with a first end facing a first end of a second arm of the partially enclosed ring to defines a gap having a width, the first and second arms define an undercut region below the gap; and a lower surface extending between the partially enclosed ring and the head, wherein the lower surface and the partially enclosed ring are configured to receive a container and wherein the head has a tab that defines a slot configured to receive a flange of the container.

2. The handle of claim 1 further comprising at least one container alignment member positioned within the slot.

3. The handle of claim 2 wherein the tab has at least one alignment indicator corresponding to the container alignment member.

4. The handle of claim 3 wherein the at least one alignment indicator comprises a recess in a top surface of the tab.

5. The handle of claim 1 wherein the head includes a coupler configured to engage a shaving razor cartridge.

6. The handle of claim 1 wherein the width of the gap is in the range of between 4 mm and 17 mm.

7. The handle of claim 1 wherein the first and second arms each have a second end that are spaced apart by a width.

8. The handle of claim 1 wherein the first and second arms each have a second end that are spaced apart by a width that is greater than the width of the gap.

9. The handle of claim 1 wherein a top surface of the tab has one or more windows.

10. A shaving razor system comprising:

a handle having a head at a first end with a tab that defines a slot and a partially enclosed ring at a second end, the partially enclosed ring having a first arm with a first end facing a first end of a second arm of the partially enclosed ring to define a gap having a width, the first and second arms define an undercut region below the gap;

a lower surface extending between the head and the partially enclosed ring;

a shaving razor cartridge mounted to the handle, the shaving razor cartridge defining a shave surface;

a container is mounted to the handle, the container has a flange at a first end, a cap at a second end and a body extending between the flange and the cap, wherein the body is removably positioned within the partially enclosed ring and the flange is removably positioned within the slot of the tab.

11. The shaving razor system of claim 10 wherein the body is supported by the lower surface.

12. The shaving razor system of claim 11 wherein the first arm has a second end that faces a second end of the second arm to define a width.

13. The shaving razor system of claim 12 wherein the width between the second ends of the first and second arms is greater than the width of the gap.

14. The shaving razor system of claim 10 wherein the shave surface and a top surface of the body face the same direction.

15. The shaving razor system of claim 10 wherein the first and second arms each have a respective concave inner surface.

16. The shaving razor system of claim 10 wherein the tab has at least one container alignment member that engages a corresponding handle alignment member on the flange of the container.

17. The shaving razor system of claim 16 wherein the flange comprises a rear wall and the handle alignment member is a notch that extends into the flange from the rear wall.

18. A method of assembling a shaving razor system comprising:

mounting a shaving razor cartridge to a first end of a handle;

die cutting at least one notch into a flange of a container;

positioning the flange within a slot of the handle;

engaging the notch of the flange with a container alignment member on the handle;

inserting a body of the container through a gap defined by a partially enclosed ring on the handle; and positioning the body on a lower surface of the handle, wherein said inserting the body is performed after engaging the notch.

19. The method of claim 18 further comprising capturing the body within the partially enclosed ring.

* * * * *